US008608116B2

(12) United States Patent
Ortiz Rivas

(10) Patent No.: US 8,608,116 B2
(45) Date of Patent: Dec. 17, 2013

(54) ADJUSTABLE GUARD RAIL SYSTEM FOR RAILROAD TURNOUTS

(76) Inventor: Arturo Alvaro Ortiz Rivas, Monterrey (MX)

( * ) Notice: Subject to any disclaimer, the term of this patent is extended or adjusted under 35 U.S.C. 154(b) by 0 days.

(21) Appl. No.: 13/447,474

(22) Filed: Apr. 16, 2012

(65) Prior Publication Data

US 2012/0261524 A1 Oct. 18, 2012

(30) Foreign Application Priority Data

Apr. 18, 2011 (MX) ..... MX/a/2011/004104

(51) Int. Cl.
*E01B 7/00* (2006.01)

(52) U.S. Cl.
USPC ..... 246/456; 246/454

(58) Field of Classification Search
USPC ..... 246/454, 455, 456, 457, 458
See application file for complete search history.

(56) References Cited

U.S. PATENT DOCUMENTS

| | | | | |
|---|---|---|---|---|
| 3,063,641 | A * | 11/1962 | Frey | 238/22 |
| 3,166,279 | A * | 1/1965 | Kern | 246/441 |
| 4,386,751 | A * | 6/1983 | Meyer | 246/441 |
| 6,119,988 | A * | 9/2000 | Rivas | 246/454 |
| 6,276,643 | B1 * | 8/2001 | Ortiz Rivas | 246/454 |
| 6,732,980 | B2 * | 5/2004 | Hein | 246/455 |
| 7,137,601 | B2 * | 11/2006 | Christ et al. | 246/456 |
| 2012/0261524 | A1 * | 10/2012 | Ortiz Rivas | 246/456 |

* cited by examiner

*Primary Examiner* — Jason C Smith
(74) *Attorney, Agent, or Firm* — John A. Thomas

(57) ABSTRACT

A structure and counter system for railroad switching, characterized by a base support plate with a lower flat surface which on its upper side includes a first flat section with two protruding hooking elements that hold the skid's inside tab on the rail where the wheels roll on, and also includes an outer section of greater thickness that defines a stopping device that ends on the border of the skid's outer tab within the same rail. This base plate includes a wall perpendicular to the upper surface, covering its width, with a flat internal surface adapted to receive a fixing plate that receives the outer side of a counter rail arranged over the first flat section and separated from the hooking elements; thus being parallel to this rail.

5 Claims, 4 Drawing Sheets

ADJUSTABLE GUARD RAIL SYSTEM FOR RAILROAD TURNOUTS

INVENTION SCOPE

This invention is related to the general railroad industry; particularly, it relates to the assemblies of railroad switch fittings, and more specifically, to an innovative counter rail structure and system to switch railroad tracks.

In this application, the term "counter rail" means the same thing as "guard rail" in the U.S. usage or "check rail " in U.K. usage. This is, the "counter rail" is a double rail section of track to prevent derailments or limit damage caused by derailments, by having rail on both sides of the wheel flange, particularly at a switch.

INVENTION BACKGROUND

The railroad industry uses assemblies of railroad switch fittings for railroad tracks that allow trains to divert their path and which are arranged at the beginning of the railroad switch; they are also known as rail devices whose purpose is to properly split or cross railroad tracks, even when they take different types of shapes. Rail road switches derive from the following key devices: the switch, which allows the crossing of vehicles from one track to another one; and the mid-rail, which makes the connection between the two switches.

At the switch, the axes of both tracks meet obliquely, and these axes cut each other at the mid-rail. To separate or cross the railroad tracks, two pieces of equipment are used; they are called railroad track switches and crossings, respectively.

When two railroad tracks cut each other, this can occur in an oblique or perpendicular way, thus resulting in two kinds of completely different devices: the oblique mid-rail and the rectangular mid-rail, where the former is found much more frequently. The oblique mid-rail can also be straight or curved, depending on the configuration of the crossing tracks.

The basic elements of a railroad device are mainly the switch and the crossing point. The railroad switch is made up by a pair of switching needles with accessories, a frog, a pair of guardrails and a set of switching railroad ties.

A frog is a crossing, a special building item for railroad tracks, that allows the crossing of two railroad tracks. They are assigned a number and a type; the number is the distance ratio of the intersection of two mid-rails to the width or distance between the squared lines at such distance. The frog number determines the frog angle, the degree of the diversion and the needle curvature, or the distance from the switching point to the frog spot.

In regards to the railroad switches, they make up a part of the switch that allows the separation of railroad tracks. Due to their extension, they are frequently called "needles".

The devices more widely used are the simple switches, in which only one railroad, the diverted one, becomes separated from the general railroad, also called the main railroad or direct railroad.

The first switches built were made of needles or mobile railroad tracks and were articulated at the joint, on the diverted railroad, through a loose joint; this way, they could be arranged as an extension of any of the diverging railroad tracks. Obviously, with this arrangement, any vehicles taking the tracks not set with the needles will inevitably derail.

The railroad devices include, on the inside of the two continuous outside rails, two mobile pieces around the ends of the crossing side, and are conveniently placed to progressively adapt to such rails. These pieces, called needles, have a sharpened end due to the diversion at its adaptation point to the outside rails, called counter needles; the other end, where the rotation takes place, is called the heel.

At the common switches, both needles move concurrently tied by two or more braces, of which the closest to the end is joined to the maneuvering bar that runs under the railroads; these braces also serve to keep the adequate separation between the needles, that way when one of them is set against its counter needle, the other one leaves a clearance for the wheels' tabs. If this clearance is not achieved, and both needles are simultaneously against, or separated from, its corresponding counter needles, the derailing of the wheels will occur; in the first case, due to the narrowing of the railroad track and both wheels rolling over both needles; in the second case, due to the widening of the railroad track and both wheels from one axis rolling over the outside rails.

A switch can be molded on the end or on the heel. In the first case, a train coming from the common track will take one of the needles on its end and will follow the direction imposed by the needle; in the second case, the train will take the needles on their heels and will center the open track if the switch has been properly performed for the track carrying the train. If, by mistake, the switching maneuver is closed for this track, the wheels' tabs will lodge between the needle and the counter needle and will force their separation, thus breaking the braces that kept the normal separation between both needles. This situation is referred to as a heeled switch.

Regarding the crossings, this is the spot where the superimposition of the paths, taken by wheels whose tabs are on opposite sides, takes place. A discontinuity is forced upon both rolling paths for the wheels' tabs, between the end of the crossing point and the ends of the railroad tracks being cut off.

To restore the continuity of the rolling path, extension devices for such tracks are available. After being layered in such a way to form a path parallel to the opposite track, these tracks support the wheels by their border when their mid section is over the void, up until they fall on the corresponding track. Such extensions are called rabbit legs, and besides performing the aforementioned function, they also prevent the wheels of a vehicle moving on the arrow's direction to trip over the end of the cut off railroad track.

The spot where the other ends of the tracks meet is called the crossing heart point, where we can distinguish between the mathematical end from the real end that is somewhat behind the former due to the building pattern and to prevent its rapid wear. The end of the crossing piece is called the heel.

The crossing also includes the counter rails placed in front of the crossing angle along the outside railroad tracks, and whose purpose is to retain the outer wheels of vehicles traveling on the opposite direction to the arrows, thus preventing any swinging movement that would eject the inside wheels towards the crossing heart point, which besides causing its wear down, could also lead to the inside wheels taking the wrong path and causing the derailment.

Both, the rabbit legs and the counter rails widen slightly on their ends in order to avoid a hit from the wheels passing over and provide a smooth transition.

Since the wheel has a conical section, the wheel will descend while rolling over the rabbit leg and will then meet the heart's real end, unless the heart is lower than the corresponding point over the rabbit leg, which can be achieved by either progressively elevating the rabbit leg and keeping the heart in a horizontal plane, or by reducing the heart's elevation at least 5 mm below the level of the horizontal rabbit leg, which is the most common scenario. However, these circumstances, applicable to the new wheels, are modified when the wheels start wearing out, approaching a cylindrical shape, and at that stage, a more favorable scenario would be to have the rabbit leg and the heart's end meet at the same level. At the crossing points, a mixed system is generally used, which consists of slightly lowering the heart's end and giving the rabbit leg a trapezoidal or road hump profile, elevating it over a section of its length to then bring it back to a horizontal plane to the heart's end. Nevertheless, this procedure will not prevent some wheels from going higher or lower when going over the crossing point, depending on their wear.

The crossing points are generally arranged in a straight line, even when they have to alternate along curve railroad tracks, and they also tend to be symmetrical in regards to the angle's bisector, which allows them to be used on either direction.

The arrangement of the crossing points can be carried out in three different ways: by crossing the railroad tracks, with a special steel end and a crossing with molded steel.

The length of the counter rails is generally between 3.3 and 5.5 feet; they are placed in such a way that their middle section corresponds to the crossing void. The counter rails are generally built with ordinary rails that keep the necessary distance from the rolling path through the use of blocks, and special angular profiles are sometimes used in order to safeguard the structure's integrity and the invariability of the path.

Currently, the counter rail assemblies are used to hold and guide the train's wheels while rolling over the frog, where the counter rail supports and guides the wheel's tab.

The current assemblies and counter rail systems consist of a rail, where the train's wheels travel, and an adjacent counter rail. Between the rail and counter rail there is a separating seal, that just as the rail and counter rail, contains two transversal holes where the fixing devices go through to hold them tightly in place. This separating seal generates a separation between the rail and counter rail where the wheel's tab should go through. The separation must measure 4.76 cm ($1^{7/8}$ of an inch), or other measurement depending on the regulations.

Since the railroad tracks are made up of a profile that defines a head, a middle section and a skid, when the counter rail is incorporated along the rail where the train's wheels go through, a part of the counter rail's inside skid must be cut off in order to allow the approximation towards the rail and its attachment to the support plates. The continuous travel of the wheels, leads to the wear down of the counter rail's inside header surface caused by the wheel's tab, thus increasing the separation where the tab passes through. To fix this problem, the counter rail must be discarded and replaced.

To counteract this situation, an innovative counter rail system has been developed to switch railroad tracks, thus solving the aforementioned inconveniences.

INVENTION OBJECTIVES

This invention's main objective is to make available a counter rail system for railroad switches; one that allows a perfect installation and attachment at a right angle, and to hold and guide the train's wheels.

Another invention's objective is to allow the adjustment of the separation distance due to the wear between the counter rail and the rail, where the train's wheel travel, without such counter rail being discarded and replaced with a new one.

Another objective of the counter rail system for railroad switching, besides guaranteeing the fixing and precision at the contact areas, is to provide a better operating performance and greater assembly stability.

Another objective of the counter rail system for railroad switching is to guarantee safe operational exits and a greater durability.

And all those qualities and objectives that will become apparent when providing a general and detailed description of this invention and supported by the illustrations.

BRIEF DESCRIPTION OF THE INVENTION

Generally speaking, the counter rail system for railroad switching, according to this invention, consists of a base support plate with a rectangular shape, a lower flat surface which on its upper side includes a first flat section with two protruding hooking elements adapted to receive, hold and hook the interior tab of rail skid where the wheels roll on, and also includes an outer section of greater thickness attached to the flat section. This defines a stopping device to receive and hold the border of the skid's outer tab within the same rail. This plate includes a pair of boreholes spaced at the limit where the stopping device is located for the placement of nails that besides holding this base support plate over a railroad tie, they hold firmly the border of the skids outer tab on this rail against the aforementioned plate. This base plate also includes a vertical wall perpendicular to the upper surface, covering its total width, with a flat internal surface adapted to receive a fixing plate that receives the outer side of a counter rail arranged over the first flat section and separated from the hooking elements; thus being parallel to this rail. The counter rail, the fixing plate and the vertical wall include cross-sectional boreholes for the insertion of fixing devices that firmly affix the counter rail against the vertical wall on the support plate. This support plate includes a second pair of boreholes on a second flat section to insert nails to affix this plate over a railroad tie.

On its preferred modality, these hooking devices come out from the surface of the first flat section, and extend at an oblique angle to receive and hold firmly the inside tab of a rail's skid where the train wheels roll over.

In another preferred modality of the invention, the counter rail includes a monolithic structure that defines an upper section in the shape of a rail heading, a middle section with cross-sectional boreholes and an lower section angled to the outside with an outer side tab along its whole longitudinal section, jointly defining a lower flat surface adapted to make contact with an area of the first flat section on the base support plate, and its tab extends to meet the vertical axis of the outer tab's border on the header of the counter rail. This outer side tab on the counter rail makes contact with the lower surface of the vertical wall.

This configuration allows the counter rail to sit over the base support plate and attach firmly through the fixing plate on the vertical wall of the base support plate.

On the preferred modality of the invention, the fixing plate, placed between the vertical wall of the base support plate and the counter rail, includes a middle section on the inside with a rectangular protuberance that extends along its longitudinal section, and will make contact with the outside section of the counter rail; this middle section includes the cross-sectional boreholes that coincide with the cross-sectional boreholes of the counter rail on the vertical wall and where the fixing devices go through.

On the preferred modality of the invention, the vertical wall perpendicular to the upper surface of the base support plate that defines a flat inside surface has a width that increases from the bottom up defining a cross-section of a trapezoidal shape to provide a greater resistance.

Additionally, another modality of the invention includes a separating plate of a rectangular shape that includes two vertical and separated rods that come out all the way to the lower border, according to the separation of the cross-sectional boreholes of the counter rail, fixing plate and vertical wall. The separating plate is inserted between this vertical wall of the support plate and the fixing plate of the counter rail when the inside tab of the counter rail header has worn down, thus allowing to always keep a constant separation of 4.76 cm ($1^{7/8}$ of an inch) between the rail and the counter rail, or other measurement according to the regulations.

This separating plate must have the same width along its whole wall, but the thickness might vary according to the wear suffered by the inside upper tab of the counter rail's header; this way, the counter rail will offer a longer life and will not be discarded after it wears out. This facilitates the adjustment of the separation distance between the rail and counter rail to always allow the passing through of the wheels' tab by just loosening the fixing devices, quickly inserting the separating plate and tightening the fixing devices once again.

To better understand the invention's characteristics, the description of the preferred modality is complemented by diagrams, which are an integral part of this invention and are provided for illustrative purposes, but not limited to the following.

For a better understanding of the invention, a detailed description is now provided for one of the modalities, shown on the diagrams for illustrative purposes, but not limited to, those attached to this description.

DETAILED DESCRIPTION OF THE INVENTION

The characteristic details of the counter rail system for railroad switches are clearly explained on the following description and the illustrative diagrams attached; the same reference symbols are used to specify each part.

Figure 1:
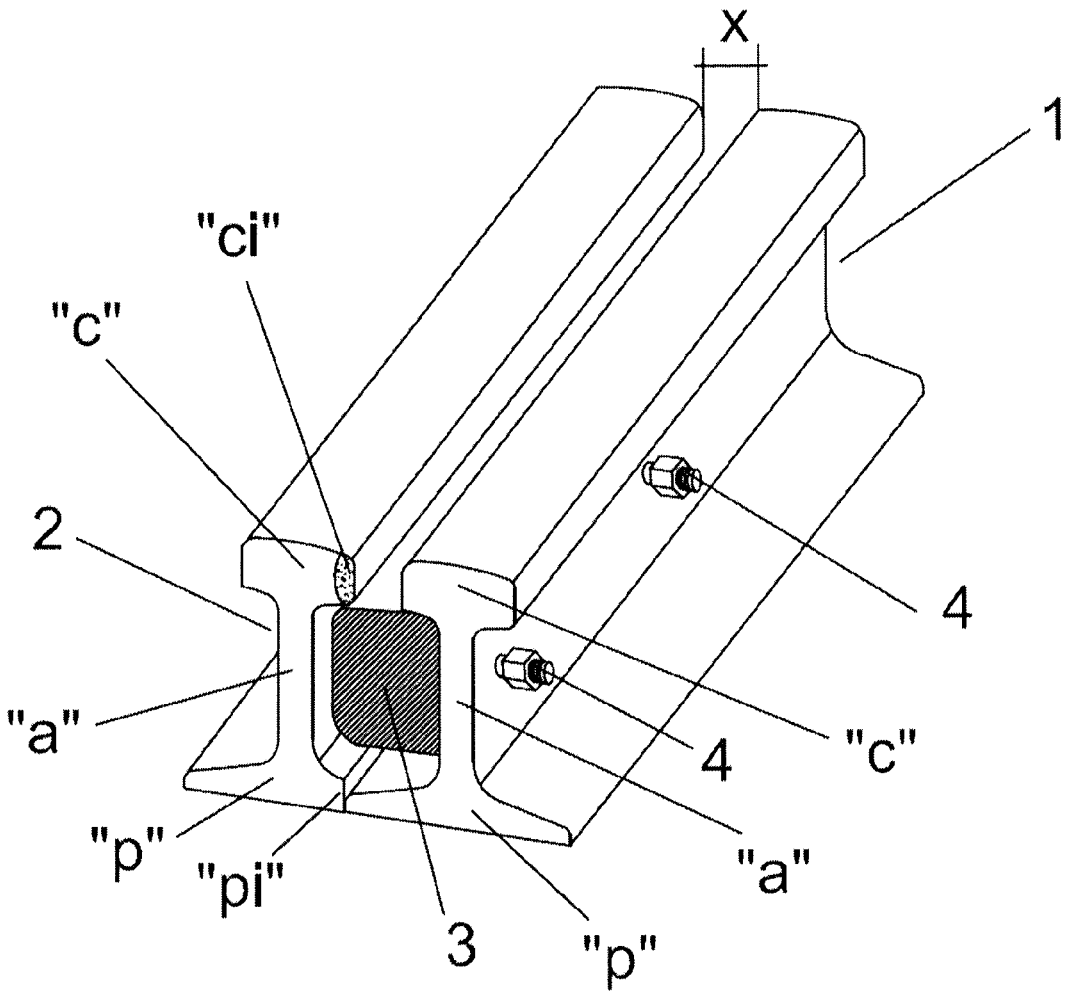
FIG. 1 shows a conventional perspective of a counter rail system for railroad switches per the technique employed.

Taking FIG. 1 as reference, it shows a conventional perspective of a section in a counter rail system for railroad switches per the technique employed. According to this figure, the current assemblies and counter rail systems consist of a rail 1 where the train's wheels travel and an adjacent counter rail 2. Between the rail 1 and counter rail 2 there is a separating seal 3, that just as the rail 1 and counter rail 2, contains two transversal holes (not shown) where the fixing devices 4 go through to hold them tightly in place. This separating seal 3 generates a separation "x" between the rail 1 and counter rail 2 where the wheel's tab should go through. The separation must measure 4.76 cm ($1^{7/8}$ of an inch), or other measurement depending on the regulations and needs.

Since the rails consist of a profile that defines a header "c", a middle section "a" and a skid "p", when the counter rail 2 is incorporated against the rail 1 where the train's wheel passes through, a section of the inside skid "pi" in the counter rail 2 must be cut-off in order to allow the approximation to the rail 1. The continuous rolling of the train's wheels makes the tab's friction to wear down the inside surface of the header "ci" in the counter rail 2, thus increasing the separation "x" where the wheel's tab passes through. To solve this problem, it is necessary to discard and replace the counter rail 2.

Figure 2:
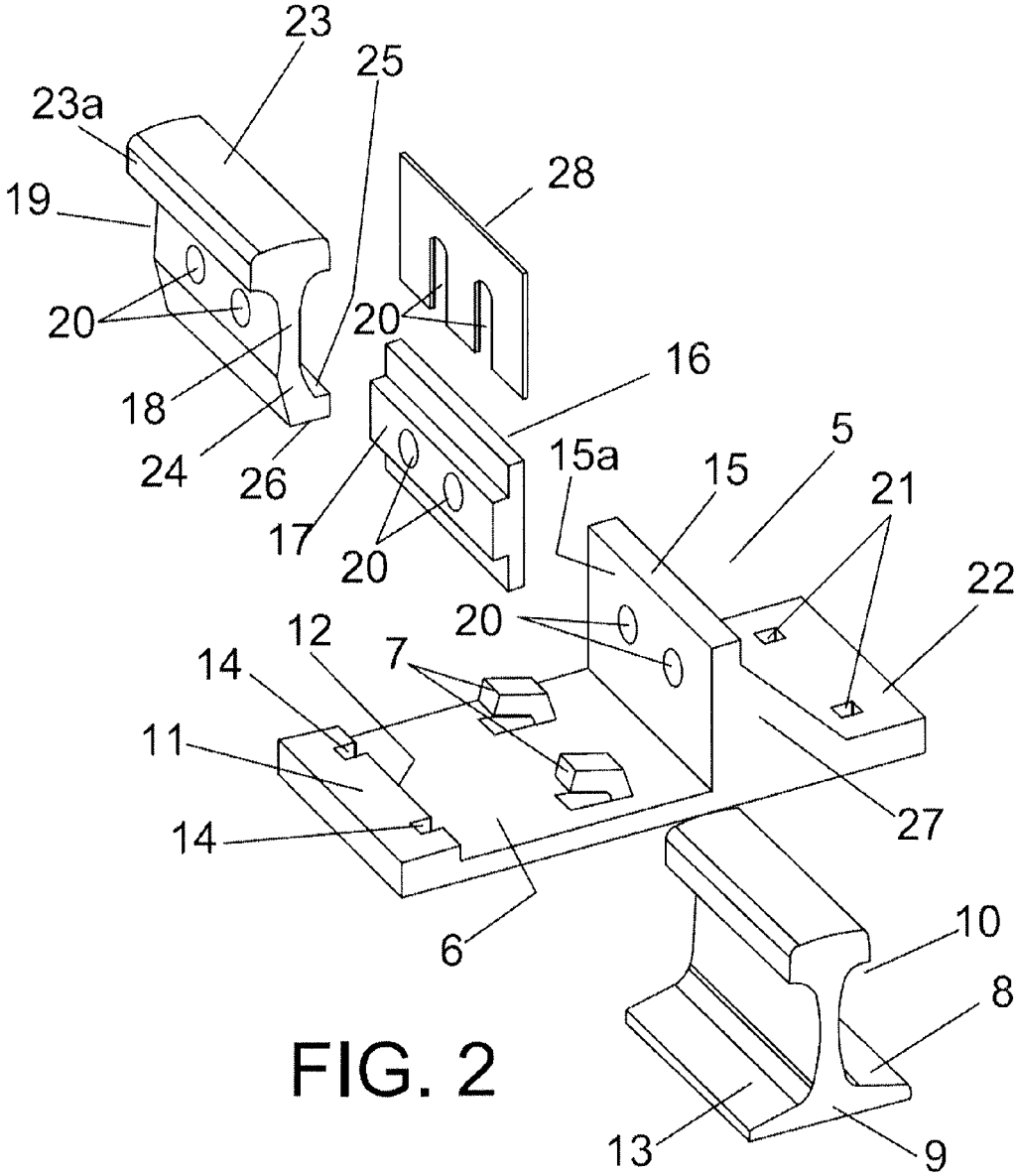
FIG. 2 shows an exploded view of the counter rail system for railroad switches, pursuant to this invention.
Figure 3:
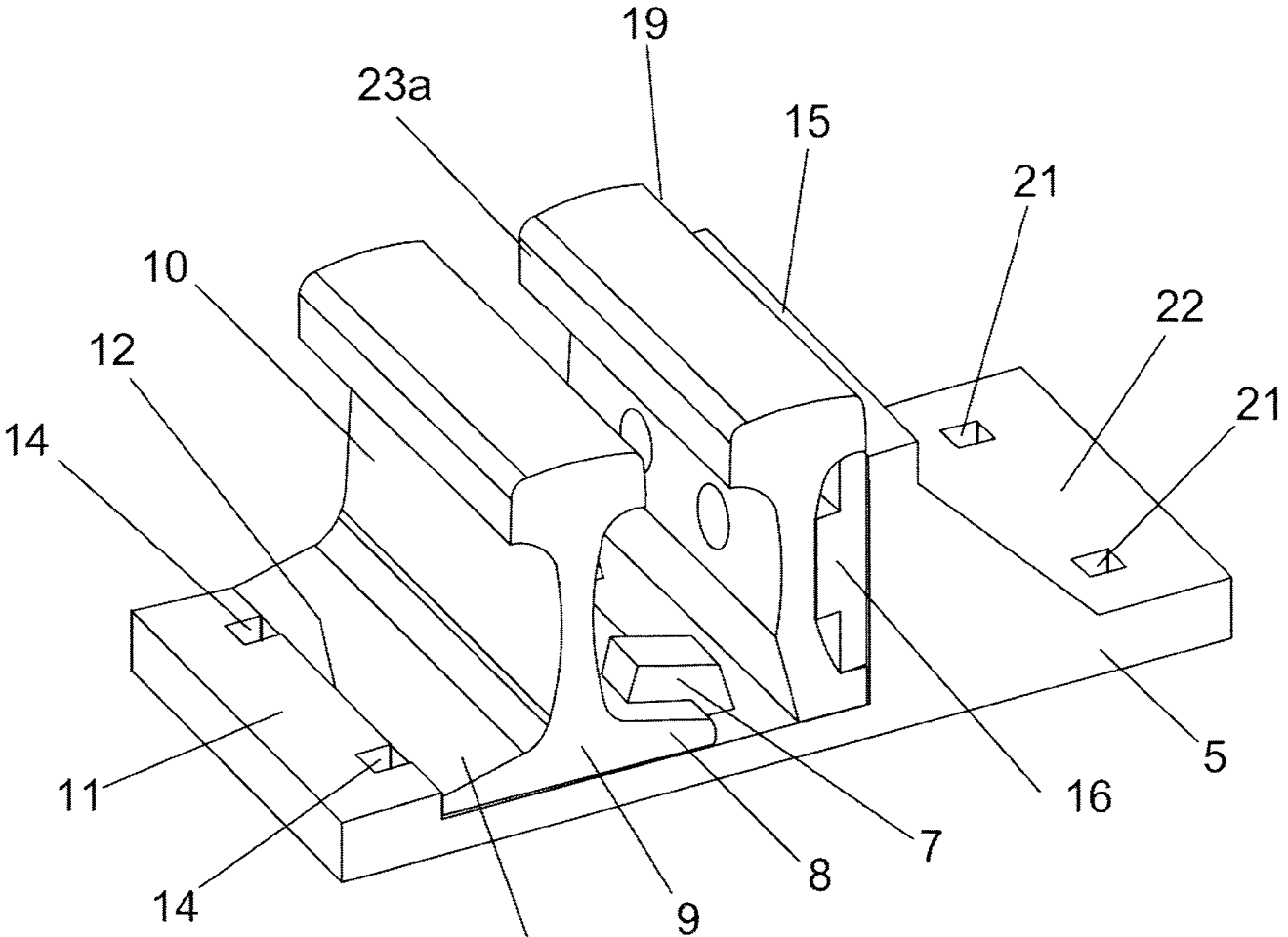
FIG. 3 shows a conventional perspective of the counter rail system for railroad switches, completely assembled and pursuant to this invention.

Taking FIGS. 2 and 3 as reference, they show the assembly's exploded view and a conventional perspective, respectively, of the counter rail system for railroad switches, pursuant to this invention. According to these figures, the system pursuant to this invention consists of a base support plate 5 with a lower flat surface which on its upper side includes a first flat section 6 with two protruding hooking elements 7 coming out from the surface and extending in an oblique profile to receive and hold firmly the interior tab 8 of the rail 10 skid 9 where the wheels roll on, and also includes an outer section of greater thickness 11 attached to the flat section 6. This defines a stopping device 12 to receive and hold the border of the skid's 9 outer tab 13 within the same rail 10. This base plate 5 includes a pair of boreholes 14 spaced at the border where the stopping device 12 is located for the placement of nails (not shown), which besides holding this base support plate 5 over a railroad tie (not shown), they hold the border of the skid's 9 outer tab 13 on this rail 10 against the aforementioned plate 5. This base plate 5 also includes a vertical wall 15 perpendicular to the upper surface, covering its total width, with a flat internal surface 15*a* adapted to receive a fixing plate 16 that includes on its inside middle section a rectangular protuberance 17 that extends along its longitudinal side, which will make contact with the outer part of the middle section 18 in a counter rail 19 arranged over the first flat section 6 and separated from the hooking elements 7; thus being parallel to this rail 10. The counter rail 19, the fixing plate 16 and the vertical wall 15, include cross-sectional boreholes 20 for the insertion of fixing devices (not shown) that firmly affix the counter rail 19 and the fixing plate 16 against the vertical wall 15 on the support plate 5. This support plate 5 includes a second pair of boreholes 21 on a second flat section 22 to insert nails (not shown) to affix this plate over a railroad tie (not shown).

This counter rail 19 includes a monolithic structure that defines an upper section 23 in the shape of a rail heading, a middle section 18 with cross-sectional boreholes 20 and a lower section angled to the outside 24 with an outer side tab 25 along its whole longitudinal section, jointly defining a lower flat surface 26 adapted to make contact with an area of the first flat section 6 on the base support plate 5. This outer side tab 25 on the counter rail 19 makes contact with the lower surface of the vertical wall 15.

This vertical wall 15 perpendicular to the upper surface of the base support plate 5 that defines a flat inside surface 15*a*, has a width that increases from the bottom up defining a cross-section of a trapezoidal shape 27 to provide a greater resistance.

Furthermore, this system includes a separating plate 28 with a mostly rectangular shape that includes two vertical and separated rods 29 that come out all the way to the lower border, according to the separation of the cross-sectional boreholes 20 of the counter rail 20, fixing plate 16 and vertical wall 15. This separating plate 28 is inserted between this vertical wall 15 of the base support plate 5 and the fixing plate 16 of the counter rail 19 when the inside tab 23*a* of the counter rail 19 header has worn down, thus allowing to always keep a constant separation "x" of 4.76 cm ($1^{7/8}$ of an inch) between the rail 10 and the counter rail 19.

Figure 4:
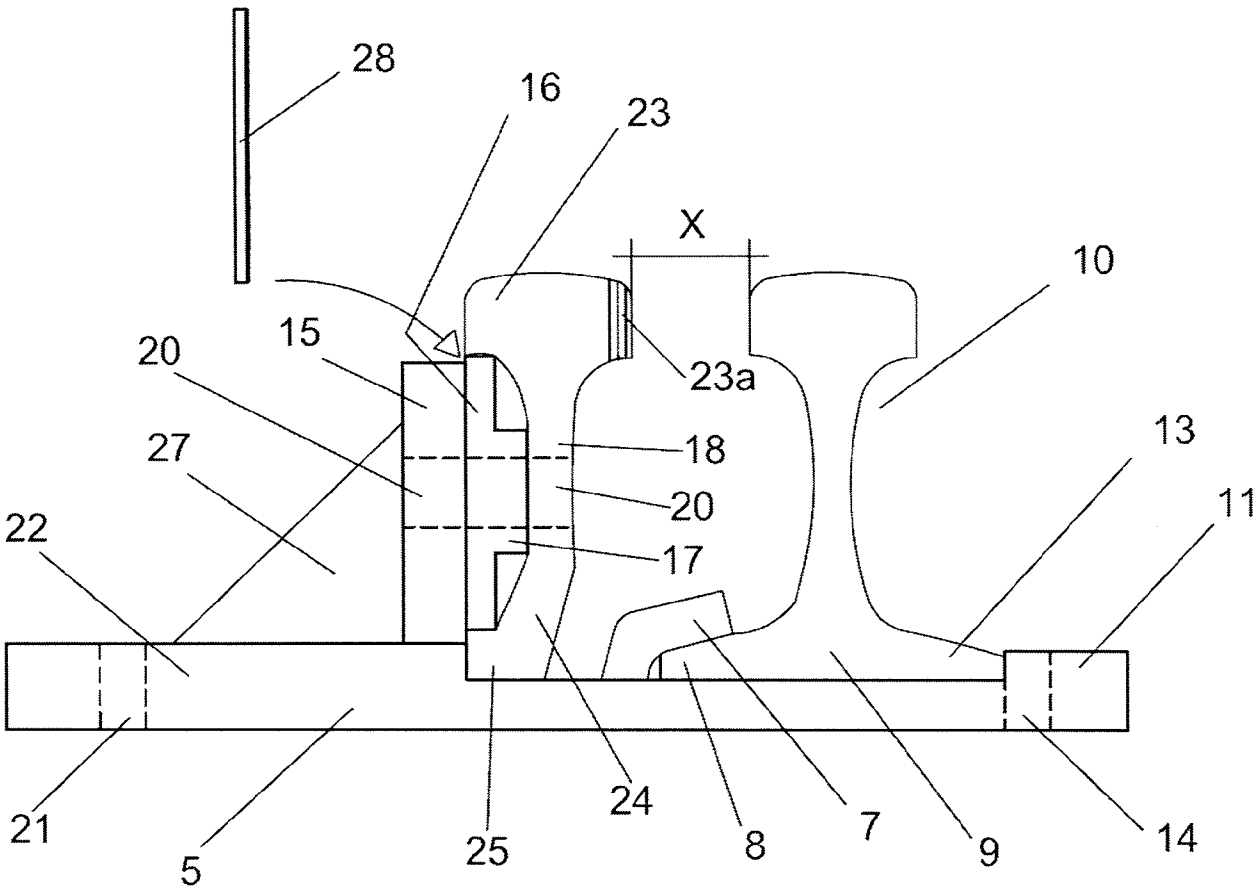
FIG. 4 shows a cross-sectional view of the counter rail system for railroad switches, completely assembled and pursuant to this invention.

Taking FIG. 4 as reverence, the same numerical references are used, as in FIGS. 2 and 3, to illustrate the same devices of the counter rail system for railroad switches. This figure shows the distribution of the system's elements once assembled.

The invention has been sufficiently described so that a person with average knowledge on this subject will be able to reproduce and obtain the results stated on this invention. However, anyone with the technical knowledge related to this invention might be able to make modifications not described on this application. Nevertheless, if these modifications on a specific structure, or during the production process, require the information stated in the following claims, such structures shall be included within the scope of this invention.

The invention claimed is:

1. A counter rail system for railroad switching comprising:

a base plate having a lower flat surface and upper side;

the upper side including a first flat section having at least two protruding hooking elements adapted to receive, hold and hook the interior tab of a rail skid, and further including an outer section of greater thickness attached to the plane section of the first flat section;

the base plate further having a vertical wall perpendicular to the base plate, covering its total width;

the skid having an outer tab;

a stopping device to receive and hold the outer tab of the skid;

the base plate further having boreholes at the location of the stopping device for the placement of nails; the nails holding the outer tab against the base plate;

a fixing plate, and;

the base plate further having a flat inte-rnal surface adapted to receive the fixing plate; and, the fixing plate adapted to receive the side of a counter rail positioned over the first flat section and separated from the hooking elements.

2. The counter rail system of claim 1, further comprising:

a monolithic structure defining an upper section in the shape of a rail; a middle section, and a lower section; where the lower section is angled to the outside of the counter rail system;

the lower section having an outer side tab along its longitudinal section, which lower section and outer side tab jointly define a lower flat surface adapted to make contact with an area of the first flat section of the base support plate.

3. The counter rail system of claim 1 where the fixing plate further has a middle section; the middle section having a rectangular protuberance extending along its longitudinal section; the rectangular protuberance making contact with the counter rail; the middle section including cross-sectional boreholes corresponding with second cross-sectional boreholes in the counter rail.

4. The counter rail system of claim 3 further including a separating plate; the separating plate having at least two arms that defining slots; the distance between the slots corresponding the separation of the cross-sectional boreholes in the middle section of the fixing plate and the second cross-sectional boreholes in the counter rail.

5. The counter rail system of claim 1 where the vertical wall has a width that increases from the base plate upward, thus defining a cross-section of substantially trapezoidal shape.

* * * * *